US007587919B1

(12) United States Patent
Young

(10) Patent No.: US 7,587,919 B1
(45) Date of Patent: Sep. 15, 2009

(54) WEAR RESISTANT COATED SHEET METAL DIE AND METHOD TO MANUFACTURE A WEAR RESISTANT COATED SHEET METAL FORMING DIE

(75) Inventor: Darryl L. Young, Belleville, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 0 days.

(21) Appl. No.: 12/060,493

(22) Filed: Apr. 1, 2008

(51) Int. Cl.
*B21D 37/18* (2006.01)

(52) U.S. Cl. ..... 72/41; 72/467; 72/47; 72/273; 76/107.1; 76/107.4; 164/6; 164/46; 249/114.1; 249/135

(58) Field of Classification Search ..... 76/107.1, 76/107.4; 72/41, 46, 47, 273, 274, 370.06, 72/467, 468; 164/6, 46; 249/114.1, 135
See application file for complete search history.

(56) References Cited

U.S. PATENT DOCUMENTS

| | | | | |
|---|---|---|---|---|
| 4,095,449 | A * | 6/1978 | Roach et al. | 72/467 |
| 4,982,596 | A * | 1/1991 | Peterson et al. | 72/467 |
| 5,009,723 | A * | 4/1991 | Honkura et al. | 72/274 |
| 5,069,089 | A | 12/1991 | Yasuno et al. | |
| 5,099,723 | A * | 3/1992 | Ziemek | 72/254 |
| 5,233,738 | A * | 8/1993 | Finkbeiner et al. | 72/370.06 |
| 5,318,091 | A | 6/1994 | Pavoni et al. | |
| 6,370,934 | B1 * | 4/2002 | Maier | 72/467 |

FOREIGN PATENT DOCUMENTS

JP 63069963 3/1988

OTHER PUBLICATIONS

Larsson, Mats Why Surface Coat Moulds and Dies? Recent Advances in Manufacture & Use of Tools & Dies and Stamping of Steel . . . 2004 Published on CSA.com.

* cited by examiner

*Primary Examiner*—David B Jones
(74) *Attorney, Agent, or Firm*—Raymond L. Coppiellie; Ford Global Technologies, LLC

(57) ABSTRACT

A method to manufacture a steel die having a Physical Vapor Deposition wear resistant coating on a profile surface and a steel die formed thereby is disclosed. The steel die is subjected to quenching and tempering to achieve a Rockwell hardness in the range of about 40-45 Rc and then subjected to machining to form a profile surface. The surface is then subjected to Physical Vapor Deposition of a wear resistant coating that may be multiple layers of CrN, AlCrN, TiCrN, TiN, TiCN or TiAlN, and preferably is alternating layers of TiN—TiCN—TiN. The coating is applied at a sufficient thickness to impart wear resistance to the steel die. The steel dies are useful in sheet metal stamping operations.

11 Claims, 2 Drawing Sheets

25

WEAR RESISTANT COATED SHEET METAL DIE AND METHOD TO MANUFACTURE A WEAR RESISTANT COATED SHEET METAL FORMING DIE

TECHNICAL ART

Typical manufacturing processes for sheet metal stamping dies is to machine the tool to rough dimensions, quench and temper the die to the final working hardness (full hardness, typically 55-64 Rc) and then grind or machine the die to finished dimensions, Machining and grinding after quench and temper is very slow and expensive because of the high hardness of the tool. Of particular expense is the manual grinding process which needs to be undertaken to get one surface of the tool flat prior to setting the tool on a milling machine or surface grinder. Machining to finished treatment in the soft condition is not possible because the metallurgical transformations that take place during heat treatment causes dimensional changes in the tool. Tools are quenched and tempered to a high Rockwell hardness for two reasons. First, hardness at the surface promotes longevity of the tool by resisting wear. Second, hardness in the tool's cross section resists plastic deformation of the tool when forming a piece of sheet metal.

There is a need to reduce the time and expense to make steel dies to produce sheet metal parts.

There is further a need to create inexpensive steel dies for metal stamping operations.

These and other objects can be understood by reading the following description and claims.

SUMMARY OF THE INVENTION

In one embodiment, the present invention relates to a method to manufacture a sheet metal stamping die having a top member and a bottom member. The method may comprise (a) quenching and tempering a steel die at a temperature sufficient to impart a final hardness to the steel die in a range of about 35-50 Rc, and a compressive strength in a range of about 1200-2000 MPa;

(b) machining the steel die to obtain a desired final dimension and profile surface;

(c) applying by physical vapor deposition at least one layer of a wear resistant coating to said profile surface to impart wear resistance to said profile surface.

The wear resistant coating layer may be selected from the group consisting of CrN, AlCrN, TiCrN, TiN, TiCN, and TiAlN, and in another embodiment, may be composed of multiple layers of alternating TiN—TiCN—TiN. The wear resistant coating is preferably applied by Physical Vapor Deposition, and may be applied by a technique selected from sputtering, reactive sputtering, ion plating and plasma spraying. The coating, where in multiple layers or a single layer, preferably has a thickness of from about 5 to about 10 microns when used as a multiple layer, and in the range of about 3 to about 8 microns when a single material is used as a wear resistant layer.

In another embodiment, the present invention may relate to a die having a top member and a bottom member for use in sheet metal stamping operations, comprising at least one tempered and quenched steel die member having a hardness of about 40-45 Re, and a compression strength in a range of about 500-1750 MPa. At least one surface in a die member surface is machined after quenching and tempering to a desired final dimension surface to present a profile surface.

The profile surface may be coated by Physical Vapor Deposition with a wear resistant coating of sufficient thickness to impart wear resistance to said profile surface. Preferably, the wear resistant coating is at least one layer applied by Physical Vapor Deposition and may be selected from CrN, AlCrN, TiCrN, TiN, TiCN, and TiAlN. Preferably, the coating is multiple layers of wear resistant material comprised of alternating layers of TiN—TiCN—TiN. The coating may be applied by a technique selected from sputtering, reactive sputtering, ion plating and plasma spraying. Each layer has a thickness of about 0.1 microns to about 5 microns, and the total wear resistant layer has a thickness of about 5 microns to about 10 microns. The steel die is resistant to plastic deformation at 1500 MPa.

In another embodiment, the present invention is a steel die comprised of a top member and a bottom member, each having a complimentary surface profile. Each die member may be subjected to tempering, quenching and machining to create the profiles, and at least one of the profiles is coated by physical vapor deposition with a wear resistant material of sufficient thickness to wear resistance to said surface profile.

DETAILED DESCRIPTION OF THE PREFERRED EMBODIMENT

Figure 1:
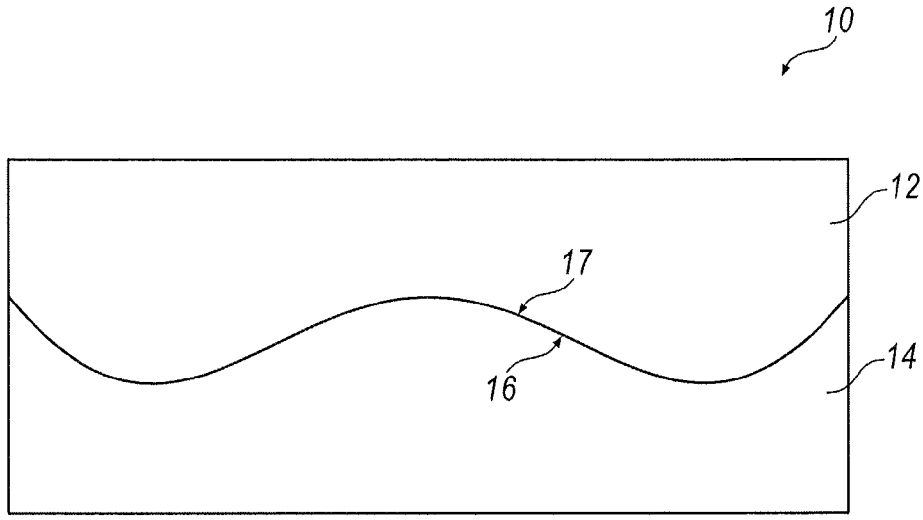
FIG. 1 is a side view of a steel die, showing a top member, a bottom member and complimentary surface profiles in each member.

Turning now to the drawings wherein like numbers refer to like structures, and preferably to FIG. 1, there is shown therein a steel die 10 having a top member 12, a bottom member 14, and preferably complimentary surface profiles 17 and 16, respectively. The steel die members are preferably quenched and tempered at a sufficient temperature to provide members having a Rockwell hardness in the range of about 40 to 45 Rc, and a compressive strength of about 1500 to 1750 MPa. The profiles are preferably cut into the steel members after they have been subjected to quenching and tempering, as steel in the hardness of 40-45 RC range may still be machined economically and easily.

Figure 2:
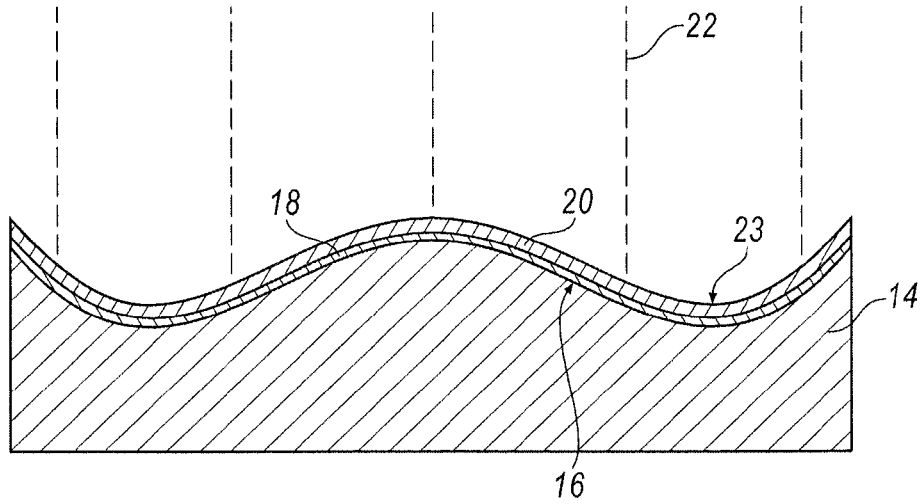
FIG. 2 is a cutaway side view of one member of the steel die, showing the profile and layers of wear resistant coating applied thereon by physical vapor deposition.

Referring now to FIG. 2, there is showing therein a cutaway side view of die member 14, showing the coating 23, being deposited onto the profile surface 16. Specifically, coating 23 is a wear resistant material, or a series of wear resistant materials, that may be applied in a single coat, or in multiple coating 18 and 20, by physical vapor deposition 22 onto the surface profile to impart wear resistance to the surface profile. While only one surface profile is discussed, it is apparent to those of ordinary skill in the art that both surface profiles could be coated with the wear resistant materials disclosed. Specifically, member 14 is preferably coated with multiple layers of wear resistant material selected from the group consisting of CrN, AlCrN, TiCrN, TiN, TiCN and TiAlN to coat the surface profile to impart wear resistance to the surface profile. Most preferably, the surface coating may be comprised of multiple alternating layers of coatings of TiN—TiCN—TiN. A single coating layer is applied in sufficient thicknesses to form a layer having a thickness in the range of from about 3 microns to about 8 microns in thickness. When multiple layers are applied, the total layer may have a thickness of about 5 microns to about 10 microns, and the individual coating layers may have a thickness of from about 0.1 microns to about 5 microns. The coatings are preferably applied by Physical Vapor Deposition techniques, such as sputtering, reactive sputtering, ion plating and plasma spraying, as is well known to those skilled in the art. Whereas certain PVD techniques are disclosed, it is understood that any PVD technique may be used to deposit the layers of coatings to the surface profile. The technique selected must impart sufficient adhesion of the coating to the surface of the profile to prevent spalling of the coating during use of the die.

Figure 3:
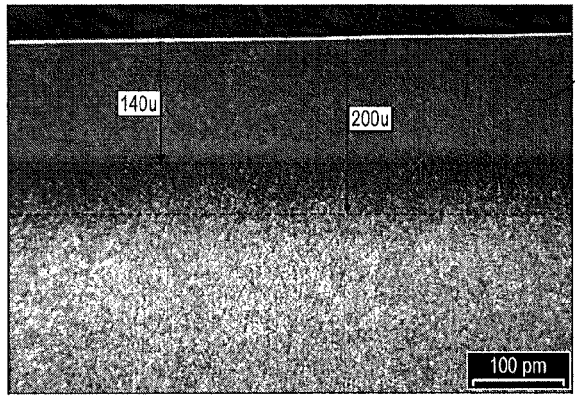
FIG. 3 is a photomicrograph of a section of the treated steel die, showing the depth of nitrogen penetration.

FIG. 3 is a photomicrograph of a section of the treated steel tool die, showing the depth of nitrogen penetration into the steel die. Nitriding a surface preparatory to applying a coating is beneficial to ensuring proper adhesion of the coating to the surface so that spalling of the coating is reduced or eliminated. Nitriding penetrates the surface of the substrate, in this case the die, and produces a case which is harder and stiffer than the steel tool die without nitriding. Nitriding and then top coating with a Physical Vapor Deposition layer is commonly referred to as a duplex surface treatment and is a preferred embodiment for building a tool according to the present invention. Nitrogen penetration 25 is seen to a depth of about 140 microns and transitions back to steel such that below about 200 microns, there is no perceptible nitrogen penetration. Typically, the nitrided substrate has a case depth of about 0.1 to about 0.25 mm.

Figure 4:
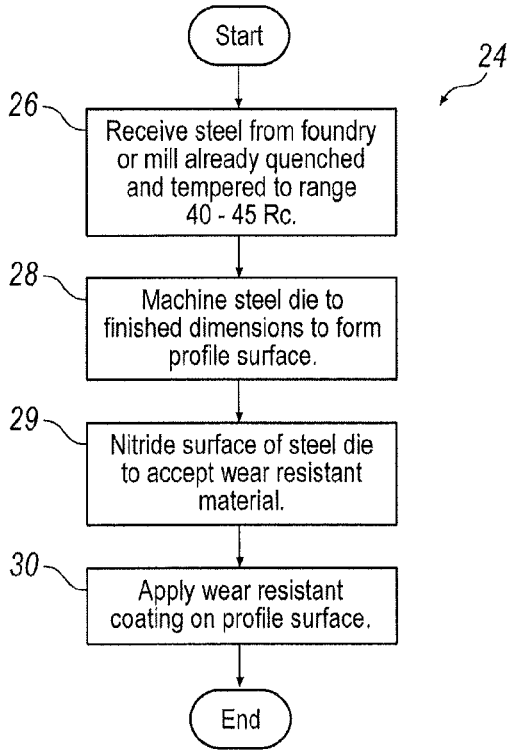
FIG. 4 is a flow chart representing one method to manufacture the steel die of the present invention.

FIG. 4 is a schematic flowchart of one method 24 to manufacture the steel die of the present invention. Specifically, in step 26, at least one steel die is received from a source already quenched and tempered to a Rockwell harness in a range of about 40 to 45 Rc. Steel in this range of Rockwell hardness may be readily machined on site, so that at step 28, the steel die is machined to desired finish dimensions and to form a profile surface, Step 29 is nitriding the steel die to a depth sufficient to permit adhesion of a wear resistant coating by PVD techniques. Typically, as seen in FIG. 3, the nitrogen penetrates the steel surface to a depth of about 200 microns. Once this step is completed, the steel die may be subjected at step 30 to PVD techniques to apply a coating of wear resistant material of sufficient thickness to resistant wear during operation of the die. Specifically, the PVD techniques may be as disclosed above, or may be any other PVD technique that may apply a coating with sufficient adhesion to the surface to prevent spalling of the coating during operation of the die.

The die so manufactured may be used in sheet metal stamping operations or in any other operation wherein it is necessary to subject a metal to compressive forces to create a finished formed metal piece.

Those skilled in the art recognize that the words used in this specification are words of description, and not words of limitation. Many variations and modifications are possible without departing form the scope and spirit of the invention and set forth in the appended claims.

What is claimed as new and desired to be protected by Letters Patent of the United States is:

1. A method to manufacture a sheet metal stamping die having a top member and a bottom member, comprising:

(a) quenching and tempering a steel die at a temperature sufficient to impart a final hardness to the steel die in a range of about 35-50 Rc, and a compressive strength in a range of about 1200-2000 MPa;

(b) machining the steel die to obtain a desired final dimension and profile surface;

(c) applying by physical vapor deposition at least one layer of a wear resistant coating comprised of multiple layers of alternating TiN—TiCN—TiN to said profile surface to impart wear resistance to said profile surface.

2. The method of claim 1, wherein said coating is applied by a technique selected from sputtering, reactive sputtering, ion plating and plasma spraying.

3. The method of claim 1, wherein said coating has a thickness of from about 3 microns to about 8 microns.

4. The method of claim 1, wherein said coating is comprised of multiple layers, each said layer having a thickness in a range of about 0.1 microns to about 5 microns; said coating having a range of about 5 microns to about 10 microns.

5. A die having a top member and a bottom member for use in sheet metal stamping operations, comprising at least one quenched and tempered steel die member having a hardness of about 40-45 Rc, and a compression strength in a range of about 1500-1750 MPa; at least one surface in a die member machined after quenching and tempering to a desired final dimension surface to present a profile surface; said profile surface coated by Physical Vapor Deposition with a wear resistant coating comprised of alternating layers of TiN—TiCN—TiN of sufficient thickness to impart wear resistance to said profile surface.

6. The steel die of claim 5, wherein said wear resistant coating is at least one layer selected from CrN, AlCrN, TiCrN, TiN, TiCN; and TiAIN.

7. The steel die of claim 6, wherein said coating has a thickness of from about 3 microns to about 8 microns.

8. The steel die of claim 5, wherein said coating is comprised of multiple layers of wear resistant coating materials.

9. The steel die of claim 8, wherein said coating is comprised of multiple layers, each said layer having a thickness in a range of about 0.1 microns to about 5 microns; said coating having a range of about 5 microns to about 10 microns.

10. The steel die of claim 5, wherein said coating is applied by a technique selected from sputtering, reactive sputtering, ion plating and plasma spraying.

11. The steel die of claim 5, wherein said die is comprised of a top member and a bottom member, each member having complimentary surface profiles; each said member subjected to tempering, quenching and machining; at least one of said profiles subjected to nitriding and coated by physical vapor deposition with a wear resistant material of sufficient thickness to wear resistance to said surface profile.

* * * * *